US009060635B1

(12) United States Patent
Neal et al.

(10) Patent No.: US 9,060,635 B1
(45) Date of Patent: Jun. 23, 2015

(54) NECKTIE AND HANDKERCHIEF HOLDING DEVICE

(76) Inventors: Margie Neal, Brandon, FL (US); Richard G. Neal, Brandon, FL (US)

( * ) Notice: Subject to any disclaimer, the term of this patent is extended or adjusted under 35 U.S.C. 154(b) by 178 days.

(21) Appl. No.: 13/552,766

(22) Filed: Jul. 19, 2012

Related U.S. Application Data

(60) Provisional application No. 61/509,422, filed on Jul. 19, 2011.

(51) Int. Cl.

| | |
|---|---|
| ***A47G 25/48*** | (2006.01) |
| ***A47G 25/74*** | (2006.01) |
| ***A47G 25/70*** | (2006.01) |
| *A47G 25/40* | (2006.01) |

(52) U.S. Cl.
CPC ..... *A47G 25/48* (2013.01); *A47G 25/40* (2013.01); *A47G 25/70* (2013.01)

(58) Field of Classification Search
CPC ..... A47G 25/00; A47G 25/06; A47G 25/14; A47G 25/18; A47G 25/28; A47G 25/30; A47G 25/76; A47G 25/40; A47G 25/48; A47G 25/74; D06F 95/002; D06F 95/004; B65D 85/185; A45C 13/03
USPC ..... 223/85–98; 206/279, 284, 288–291; 211/113, 118, 85.24; D6/326, 328; D28/73
See application file for complete search history.

(56) References Cited

U.S. PATENT DOCUMENTS

| | | | | | |
|---|---|---|---|---|---|
| 2,581,675 | A * | 1/1952 | Lefebvre | 223/85 |
| 3,236,388 | A * | 2/1966 | Ruettger | 211/113 |
| 3,958,675 | A * | 5/1976 | Rosenblum | 206/287.1 |
| 4,778,088 | A * | 10/1988 | Miller | 223/91 |
| D327,581 | S * | 7/1992 | Fildan | D6/326 |
| 5,427,230 | A * | 6/1995 | Mattox | 206/6.1 |
| 5,509,588 | A * | 4/1996 | Kimball | 223/98 |
| D659,906 | S * | 5/2012 | Whitman | D28/73 |
| 8,240,464 | B2 * | 8/2012 | Clishem | 206/286 |
| 2008/0061090 | A1 * | 3/2008 | Old | 223/85 |
| 2008/0116160 | A1 * | 5/2008 | McNicholas | 211/118 |
| 2009/0020446 | A1 * | 1/2009 | Frankenstein et al. | 206/373 |
| 2013/0248310 | A1 * | 9/2013 | Taylor-Phillips | 190/111 |

FOREIGN PATENT DOCUMENTS

| | | |
|---|---|---|
| JP | 2000342425 | * 12/2000 |

* cited by examiner

*Primary Examiner* — Ismael Izaguirre
(74) *Attorney, Agent, or Firm* — Frijouf, Rust & Pyle, P.A.

(57) ABSTRACT

A necktie and handkerchief holding device is disclosed. The necktie and handkerchief holding device allows a user to store handkerchiefs and other accessories in vertically connected pouches. Horizontal bars located between the vertically connected pouches with spring clips on each end of the bars allow for storage of neckties. The top of the necktie and handkerchief holding device has a hanger to allow the necktie and handkerchief holding device to be hung from a hanger rod in a closet or wardrobe cabinet.

19 Claims, 5 Drawing Sheets

NECKTIE AND HANDKERCHIEF HOLDING DEVICE

CROSS-REFERENCE TO RELATED APPLICATIONS

This application claims the benefit of U.S. Provisional Patent Application No. 61/509,422, filed Jul. 19, 2011, which is incorporated by reference herein in its entirety.

BACKGROUND OF THE INVENTION

1. Field of the Invention

The present invention relates generally to clothing storage. The invention is more particularly directed to a device with a hanger for storing neckties and handkerchiefs in an organized manner particularly on a hanger rod in a closet or wardrobe cabinet.

2. Description of the Prior Art

Neckties, handkerchiefs, pocket squares and other accessories including scarves and jewelry are common attire for professionals. Generally, a professional will have many neckties, handkerchiefs, pocket squares, and other accessories. It is important that the neckties remain unwrinkled for a sharp appearance. For formal occasions usually outside the workplace, different colored or styled handkerchiefs may be worn in a breast pocket. Pocket squares are often also worn in the breast pocket of formal attire as a fashion accessory. Thick scarves may be worn in the winter by men or women, or thin scarves of different colors may be by women for a stylish appearance, or to protect their "hairdos". Men and women may also wear various types of jewelry. Some people kept neckties and other accessories in a dresser drawer, though this is not desirable, as the neckties may get wrinkled and may be hard to find. The same is true for other accessories such as handkerchiefs and jewelry. Due to this, there exists a need in the art for a device to properly store all these accessories in a neat, organized, and readily accessible manner.

Initially, the prior art focused primarily on necktie storage. Early attempts at necktie storage focused on devices for hanging a plurality of neckties on a device and the device being hung from a hanger from a horizontal rod in a closet from which other clothes are also hung. This design had the advantage of easily accessibility to the neckties which are suspended from the device. The neckties are kept wrinkle-free and all neckties are clearly visible for ease in selection of a desired necktie. The main drawback to this type of design of necktie closet storage devices is that there was no provision for storage of other accessories, such as handkerchiefs.

The prior art solution for accessory storage was in some cases the use of a device with a plurality of pouches for handling a plurality of different accessories. In one design, an accessory-holding device with a hanger and a plurality of pouches for holding different types of jewelry, the hanger capable of being hung from a closet hanger rod. While the device is effective for holding different types of jewelry and being capable of being hung from a hanger rod in a closet, the device has no provision for holding neckties. The prior art also teaches other devices with a plurality of pouches. In one instance, a device suspended from a hanger rod in a closet is disclosed. The device has a plurality of pouches intended to hold shoes. This device has the disadvantage of being required to be fastened to the closet wall, so it is not capable of sliding along the length of a closet hanger rod. This device also has no provision for storing ties. The prior art also teaches a device with a plurality of pouches for storing children's playthings. However, there is no provision for hanging this device in a closet, or storing neckties on this device.

The prior art also teaches devices capable of holding both neckties and accessories. In one design, a storage cabinet with horizontal rods with clips capable of holding neckties is disclosed. A drawer is also included in the storage cabinet capable of storing handkerchiefs, or other accessories. This system has the disadvantage of requiring space outside of a closet to locate the cabinet. Also a drawer which requires to be slid open is less convenient to locate accessory items than a pouch. In another design, a device consisting of a horizontal rod and a dust cover is attachable to a regular closet clothes hanger. Neckties are capable of being hung from the horizontal rod. Spacers on the horizontal rod keep the neckties on the horizontal rod separated. Accessories, such as handkerchiefs may be kept within the dust cover, though there does not appear to be clearly defined separate pouches for the handkerchiefs to be stored. This device is intended for traveling and has the disadvantage of allowing a limited number of neckties to be stored within it and lacks separate pouches for the storage of accessories.

From the above, it is apparent that a definite need in the art exists for a necktie and handkerchief holding device. The necktie and handkerchief holding device should be able to be hung from a closet or wardrobe cabinet hanger rod. The necktie and handkerchief holding device should be able to hold a plurality of neckties in a manner which prevents the neckties from being wrinkled and which allows a particular necktie to be easily located. The necktie and handkerchief holding device should have a plurality of pouches for storage and easy retrieval of accessories such as handkerchiefs or pocket squares.

SUMMARY OF THE INVENTION

One embodiment of the invention is a necktie and handkerchief holding device comprising:

a hanger capable of being hung on a rod, an upper horizontal holding device connected to the hanger, a plurality of vertically attached pockets located on a front side and a rear side of the necktie and handkerchief holding device supported by the upper horizontal holding device, the plurality of front side and rear side vertically attached pockets capable of holding handkerchiefs, or other accessories, a plurality of lower horizontal holding devices located between each of the plurality of vertically attached pockets.

In another embodiment of the invention, the necktie and handkerchief holding device can be used in a wardrobe cabinet containing a hanging rod as well as being located on a closet hanger rod.

In a further embodiment of the invention, each of the vertically attached pouches of the necktie and handkerchief holding device vertically consists of two pouches horizontally adjacent to each other. The horizontally adjacent pouches offer more pouches to store more and different types of accessories. The horizontally adjacent pouches may be the same or different sizes. The pouches may be made of a durable fabric, or may be made of a clear plastic to facilitate easily locating accessory items within the pouches.

In yet another embodiment of the invention, the necktie and handkerchief holding device preferably utilizes clip-type fasteners to secure neckties to the necktie and handkerchief holding device. The clip-type fasteners are located at each end of the upper and plurality of lower holding devices.

In still yet another embodiment of the invention, a cover which is capable of completely enclosing the necktie and handkerchief holding device, which may be useful for travel, may be utilized.

These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, in which.

DETAILED DESCRIPTION OF REPRESENTATIVE EMBODIMENTS

Figure 1:
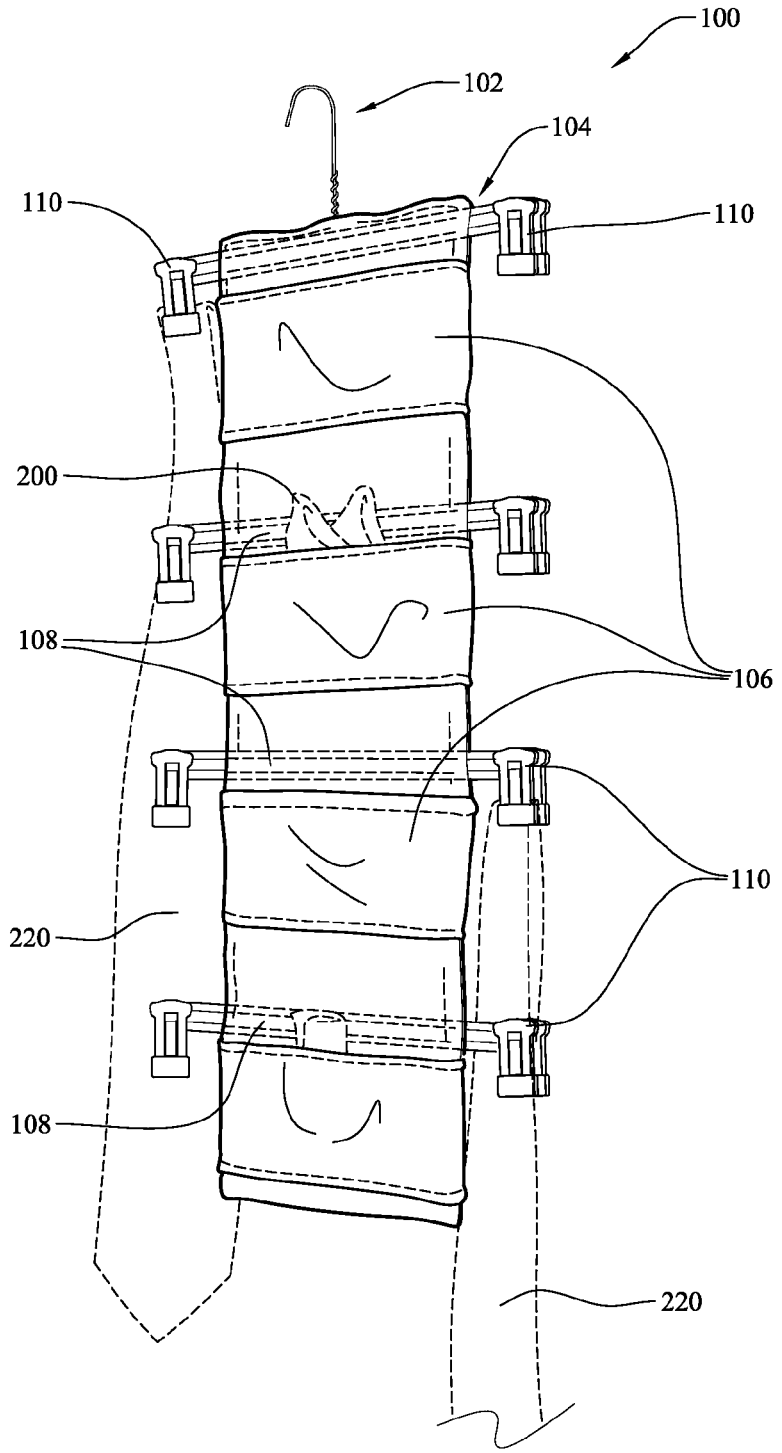
FIG. 1 illustrates a front perspective view of a first embodiment of the necktie and handkerchief holding device in accordance with the inventive concept.
Figure 2:
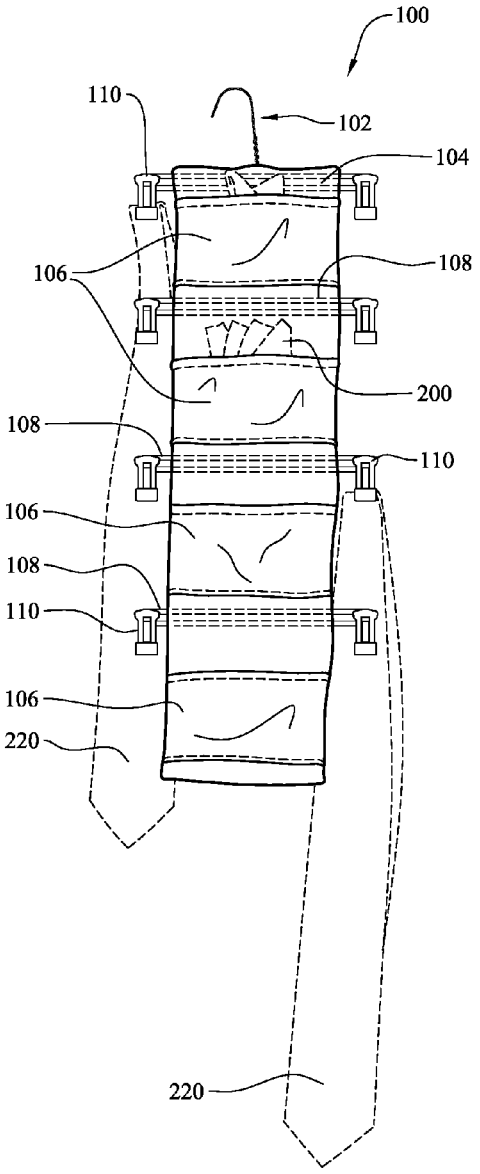
FIG. 2 illustrates a front elevation view of a first embodiment of the necktie and handkerchief holding device in accordance with the inventive concept.
Figure 3:
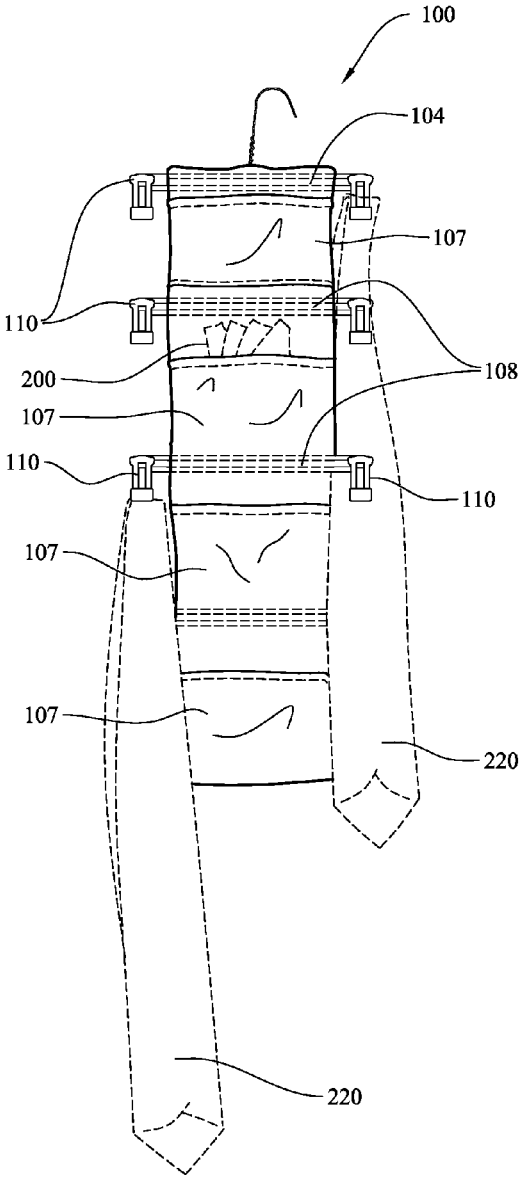
FIG. 3 illustrates a rear elevation view of a first embodiment of the necktie and handkerchief holding device in accordance with the inventive concept.
Figure 4:
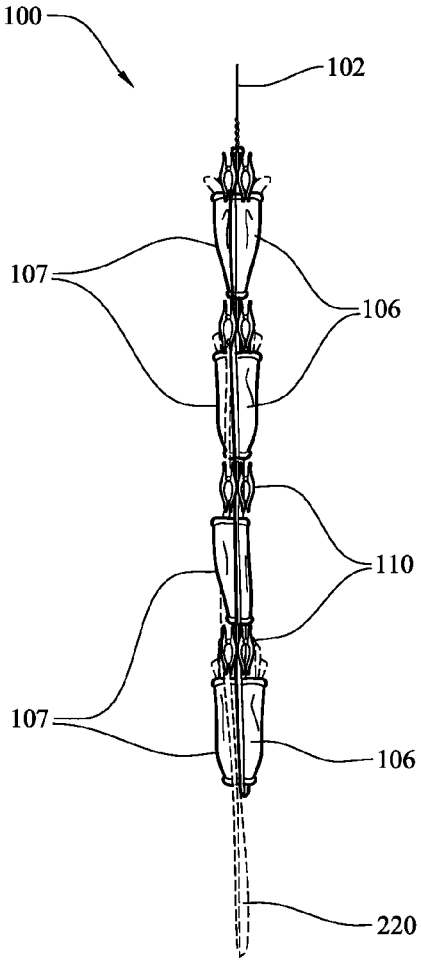
FIG. 4 illustrates a right side elevation view of a first embodiment of the necktie and handkerchief holding device in accordance with the inventive concept.
Figure 5:
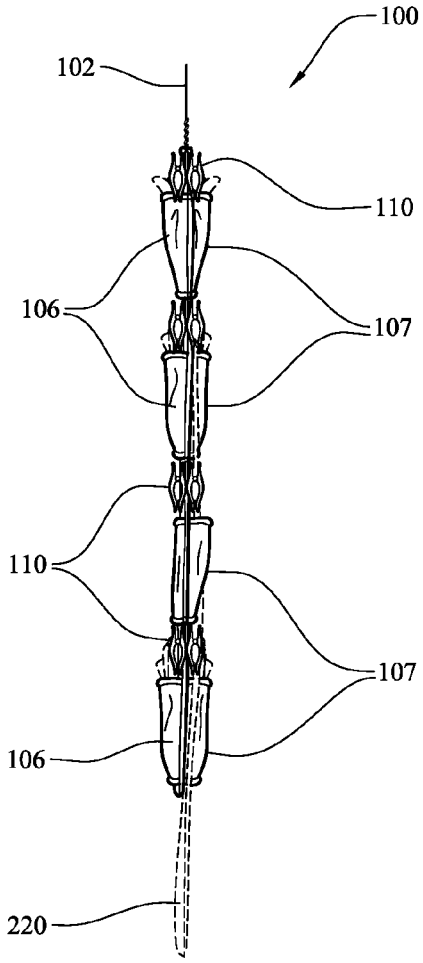
FIG. 5 illustrates a left side elevation view of a first embodiment of the necktie and handkerchief holding device in accordance with the inventive concept.
Figure 6:
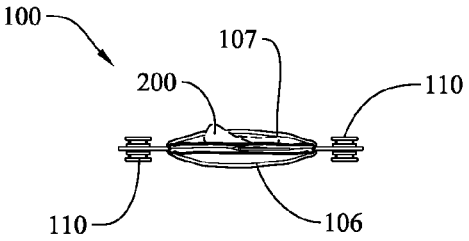
FIG. 6 illustrates a top plan view of a first embodiment of the necktie and handkerchief holding device in accordance with the inventive concept.
Figure 7:
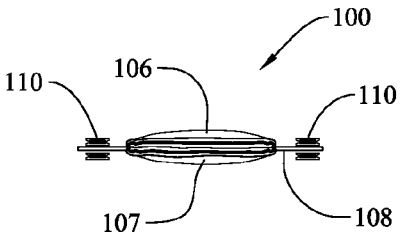
FIG. 7 illustrates a bottom plan view of a first embodiment of the necktie and handkerchief holding device in accordance with the inventive concept.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 9:
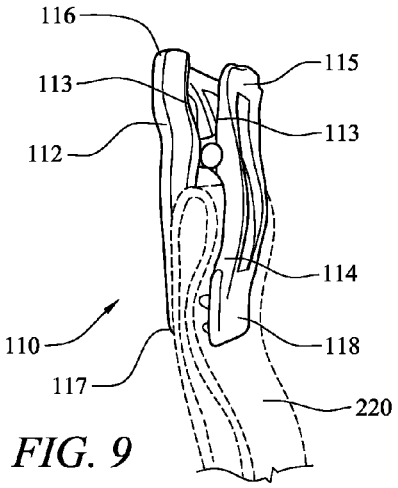
FIG. 9 illustrates a detail view of a spring clip used to hold the neckties to the necktie and handkerchief holding device in accordance with the inventive concept.

FIGS. 1-7 illustrate various views of the necktie and handkerchief holding device 100 in accordance with the inventive concept. As illustrated on FIGS. 1-7, the necktie and handkerchief holding device 100 includes a hanging member 102 capable of being hung on a closet or wardrobe hanging rod (not shown) to which an upper horizontal holding structure 104 is attached. Supported by the upper horizontal holding structure 104 is a plurality of front vertically attached pockets 106 (FIG. 2) and a plurality of rear vertically attached pockets 107 (FIG. 3) into which handkerchiefs, pocket squares or other accessory items 200 may be stored. Between each of the plurality of front vertically attached pockets 106 and rear vertically attached pockets 107 is a lower horizontal holding structure 108. At each end of the upper 104 and each of the plurality of lower horizontal holding structures 108 a spring clip 110 is attached. As illustrated in FIG. 9, each spring clip 110 comprises a base arm 112 to which a pivotable arm 114 is mounted. A torsional spring 113 keeps a lower end 118 of the spring clip pivotable arm 114 pressed against a lower end 117 of the spring clip 110 base arm 112. To use the spring clip 110, a force must be applied to the upper end 115 of the spring clip pivotable arm 114, while an opposing force is applied to the upper end 116 of the spring clip 110 base arm 112. These opposing forces cause the pivotable arm 114 to rotate counterclockwise relative to the base arm 112 to create a gap between the lower end 117 of the base arm 112 and the lower end 118 of the spring clip 110 pivotable arm 114. A portion of a necktie 220 is then placed in this gap. Then the forces applied to the upper end 115 of the spring clip pivotable arm 114 and the upper end 116 of the spring clip 110 base arm 112 are released to close the gap. Once the gap is closed the spring clip torsional spring 113 will keep a necktie 220 firmly held to the spring clip 110. Each spring clip 110 is preferably made of plastic to securely hold a necktie 220 without damaging the necktie 220.

Figure 8:
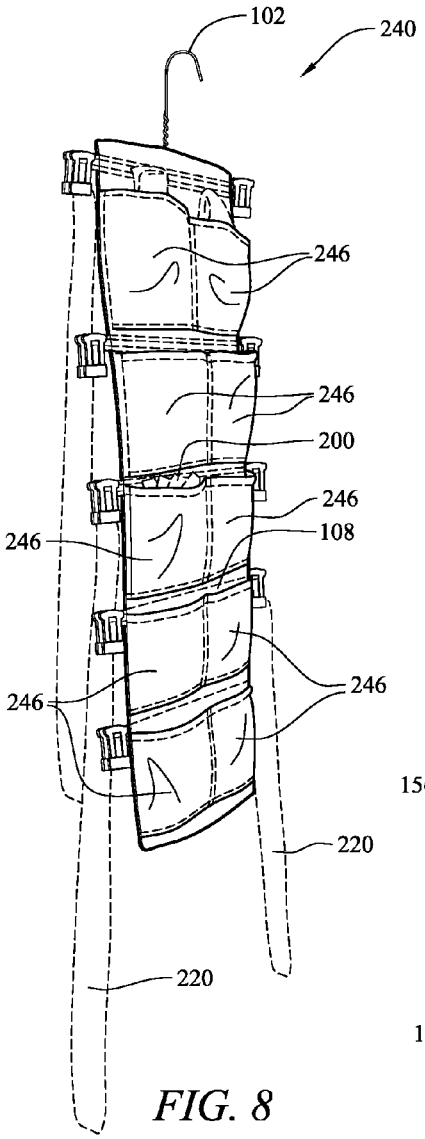
FIG. 8 illustrates a front perspective view of a second embodiment of the necktie and handkerchief holding device in accordance with the inventive concept.
Figure 11:
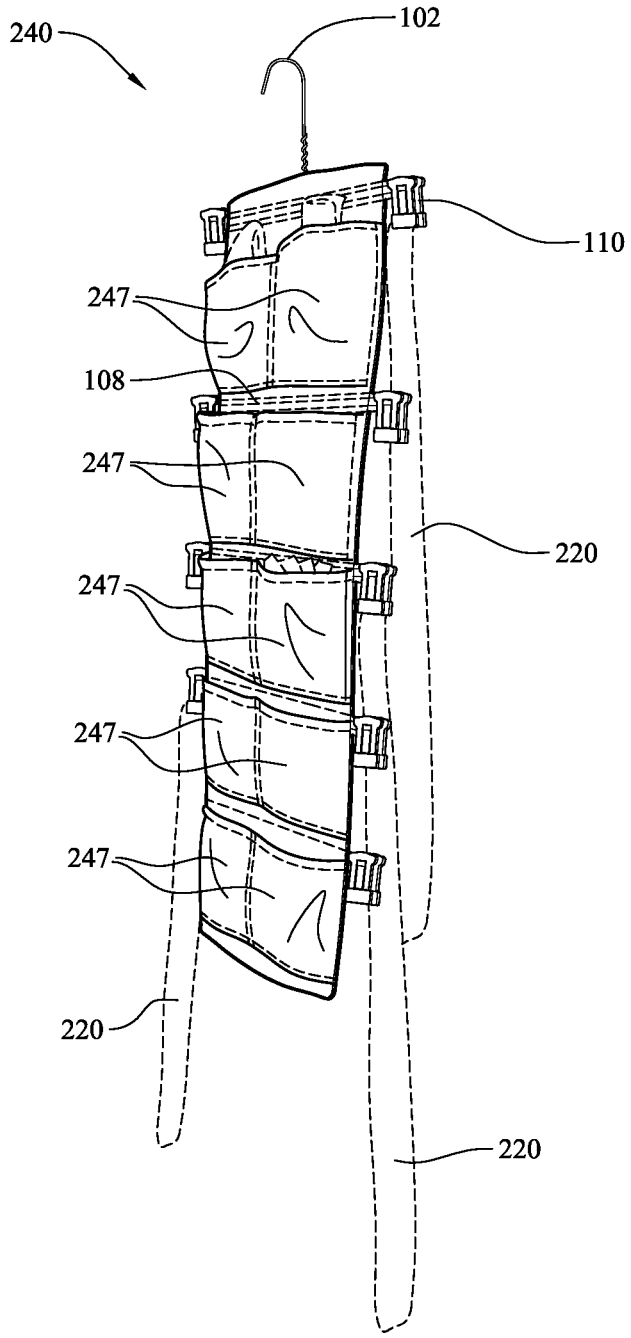
FIG. 11 illustrates a rear perspective view of a second embodiment of the necktie and handkerchief holding device in accordance with the inventive concept.

As illustrated on FIGS. 8 and 11, the present inventive concept includes a second embodiment of the necktie and handkerchief holding device 240. In the first embodiment of FIGS. 1-7, the necktie and handkerchief holding device 100 includes on the front side a set of vertically attached pockets 106 and on the rear side a set of vertically attached pockets 107 made of any type of fabric, leather, suede, transparent plastic, or other similar materials. These front side 106 and rear side vertically attached pockets 106 of the first embodiment 100 may keep handkerchiefs, scarves, head scarves, and/or any other personal accessory a person may need. In the second embodiment as illustrated in FIGS. 8 and 11 the necktie and handkerchief upper holding device 104 which supports front and rear vertically attached pockets 106 and 107, respectively, of the first embodiment is modified to be "split" horizontally into two separate pockets 246 for the front side (FIG. 8) and 247 (FIG. 11) for the rear side. Each of the two horizontally aligned front side and rear side pockets 246 and 247, respectively, may be the same size, or one of the two horizontally aligned front side and rear side pockets 246 and 247, respectively, may be bigger than the other, to facilitate storing different types and sizes of accessories. The horizontally aligned front side and rear side pockets 246 and 247, respectively, of the second embodiment 240 are made of the same materials as the front and rear pockets 106 and 107, respectively, of the first embodiment as described above. The front and rear vertically attached pockets 106 and 107, respectively, of the first embodiment offer greater storage capacity, while the front and vertically attached horizontally split pockets 246 and 247, respectively, of the second embodiment offer a greater number of smaller pockets for facilitating segregation of a greater number of accessories.

Figure 10:
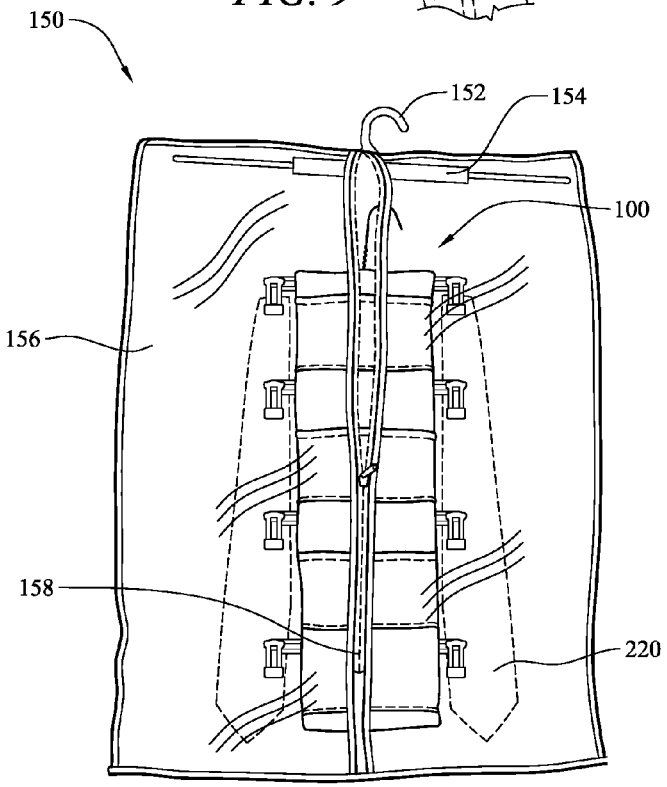
FIG. 10 illustrates a front elevation view of a protective cover for the necktie and handkerchief holding device in accordance with the inventive concept.

FIG. 10 illustrates a cover assembly 150 that may be used to completely cover the necktie and handkerchief holding device 100 to protect ties, handkerchiefs and other accessories stored in the necktie and handkerchief holding device 100 from dust, stains, etc. This cover 150 may be particularly useful if the necktie and handkerchief holding device 100 is utilized for travel, or if the neckties and handkerchiefs are not being utilized for a period of time. The cover assembly 150 includes a hanger portion 152 connected to a horizontal holding structure 154. The hanger portion 152 is utilized to hang either the first or second embodiment of the necktie and handkerchief holding device 100 and 240, respectively, to any convenient structure. Covering and attached to the horizontal holding structure 154 is a flexible cover 156 which completely encloses the first or second embodiments of the necktie and handkerchief holding device 100 or 240. The flexible cover 156 includes a zipper 158 which allows the first or second embodiments of the necktie and handkerchief holding device 100 and 240, respectively, to be placed within the flexible cover 156.

In use of the of the first 100 and second 240 embodiments of the necktie and handkerchief holding device, first, one of the first 100 and second 240 embodiments of the necktie and handkerchief holding devices is selected for use. Once one of the first 100 and second 240 embodiments of the necktie and handkerchief holding devices is selected, neckties 220 may be attached to the spring clips 110 on one of the first 100 and second 240 embodiments of the necktie and handkerchief holding devices. Handkerchiefs 200, pocket squares, and other accessories may then be stored in the front and rear side pockets 106 and 107 respectively of the first embodiment 100 or 246 of the second 240 embodiment of the necktie and handkerchief holding devices. If the neckties 220 and handkerchiefs 200 are not intended to be used for a while, or if one of the first 100 and second 240 embodiments of the necktie and handkerchief holding devices is being utilized for travel, the necktie and handkerchief holding device cover assembly 150 may be utilized to enclose one of the first 100 and second 240 embodiments of the necktie and handkerchief holding devices to protect the neckties 220, handkerchiefs 200, and other accessories from dust, stains, etc.

While the preferred embodiments of the invention have been described above, it will be recognized and understood that various modifications can be made in the invention and the appended claims are intended to cover all such modifications which may fall within the spirit and scope of the invention.

We claim:

1. A necktie and handkerchief holding device, comprising:

a hanger capable of being hung on a rod;

an upper horizontal holding device connected to the hanger;

a plurality of vertically attached pockets located on a front side and a rear side of the necktie and handkerchief holding device supported by the upper horizontal holding device, the plurality of front side and rear side vertically attached pockets capable of holding handkerchiefs, or other accessories;

a plurality of lower horizontal holding devices located between each of the plurality of vertically attached pockets; and a spring clip attached to each end of the upper horizontal holding device and each end of the plurality of lower horizontal holding devices, the spring clips capable of securely holding a necktie.

2. The necktie and handkerchief holding device of claim 1, wherein the spring clip has a base arm and a pivotable arm, a torsional spring biasing the base arm and pivotable arm to be in contact at lower ends of the base arm and pivotable arm, the pivotable arm capable of being rotated to form a gap between the lower ends of the pivotable arm and base arm, the gap capable of receiving a portion of a necktie.

3. The necktie and handkerchief holding device of claim 1, wherein each of the plurality of vertically attached pockets located on the front side and the rear side of the necktie and handkerchief holding device may comprise two pockets horizontally adjacent each other.

4. The necktie and handkerchief holding device of claim 3, wherein the two pockets horizontally adjacent each other on the front side and on the rear side of the necktie and handkerchief holding device may be one of the same size or different sizes.

5. The necktie and handkerchief holding device of claim 3, wherein the plurality of front side and rear side vertically attached pockets includes sixteen pockets.

6. The necktie and handkerchief holding device of claim 3, wherein the plurality of vertically attached pockets includes more than sixteen pockets.

7. The necktie and handkerchief holding device of claim 1, wherein the plurality of vertically attached pockets is made of one of fabric, leather, suede, or transparent plastic.

8. The necktie and handkerchief holding device of claim 1, wherein the plurality of front side and rear side vertically attached pockets includes at least eight pockets.

9. The necktie and handkerchief holding device of claim 1, wherein there are at least ten spring clips installed on the necktie and handkerchief holding device.

10. The necktie and handkerchief holding device of claim 1, wherein a cover assembly which is capable of completely enclosing the necktie and handkerchief holding device may be utilized.

11. The necktie and handkerchief holding device of claim 10, wherein the cover assembly includes a cover hanger portion connected to a cover horizontal holding structure.

12. The necktie and handkerchief holding device of claim 10, wherein the cover assembly includes a zipper to facilitate being capable of placing the necktie and handkerchief holding device within the cover assembly.

13. A method of using a necktie and handkerchief holding device, comprising:

procuring either a necktie and handkerchief holding device with a plurality of vertically attached pockets located on a front side and a rear side of the necktie and handkerchief holding device or a different necktie and handkerchief holding device with a plurality of vertically attached pockets located on a front side and a rear side of the necktie and handkerchief holding device, each vertically attached pocket on the front side and rear side having an adjacent horizontally aligned pocket, each vertically attached pocket on the front side and rear side having an adjacent horizontally aligned pocket being one of the same size or a different size;

the uppermost pocket of the vertically attached pockets on the front and rear sides attached to an upper horizontal holding device connected to the hanger;

the necktie and handkerchief holding device procured includes a plurality of lower horizontal holding devices located between each of the plurality of vertically attached pockets; and the necktie and handkerchief holding device procured includes spring clips on each end of the upper horizontal holding device and each end of the lower horizontal holding devices, the spring clips capable of securely holding a necktie.

14. The method of using the necktie and handkerchief holding device of claim 13, wherein accessories such as handkerchiefs and scarves are placed within the plurality of vertically attached pockets.

15. The method of using the necktie and handkerchief holding device of claim 14, wherein the necktie and handkerchief holding device procured includes a cover assembly which is capable of completely enclosing the necktie and handkerchief holding device.

16. The method of using the necktie and handkerchief holding device of claim 15, wherein the cover assembly of the necktie and handkerchief holding device procured includes a hanger to allow the cover assembly of being capable of being hung from a rod.

17. A necktie and handkerchief holding device comprising:

a hanger capable of being hung on a rod, an upper horizontal holding device connected to the hanger, a plurality of vertically attached pockets located on a front side and a rear side of the necktie and handkerchief holding device supported by the upper horizontal holding device, the plurality of front side and rear side vertically attached pockets capable of holding handkerchiefs, or other accessories, a plurality of lower horizontal holding devices located between each of the plurality of vertically attached pockets, wherein each end of the upper holding device and each end of the plurality of lower horizontal holding devices has a spring clip attached to each end of the plurality of lower horizontal holding devices, the spring clips capable of securely holding a necktie, wherein the spring clip has a base arm and a pivotable arm, a torsional spring biasing the base arm and pivotable arm to be in contact at lower ends of the base arm and pivotable arm, the pivotable arm capable of pivoting relative to the base arm to form a gap between the lower ends of the pivotable arm and the base arm, the gap capable of receiving a portion of a necktie, wherein each of the plurality of vertically attached pockets located on a front side and a rear side of the necktie and handkerchief holding device may comprise two pockets horizontally adjacent each other, wherein the two pockets horizontally adjacent each other may be one of the same size or different sizes, wherein the plurality of vertically attached pockets is made of one of fabric, leather, suede and transparent plastic, and wherein the plurality of front and rear side vertically attached pockets includes at least eight pockets, and wherein the necktie and handkerchief holding device contains at least ten spring clips.

18. The necktie and handkerchief holding device of claim 17 wherein a cover assembly which is capable of completely enclosing the necktie and handkerchief holding device may be utilized, wherein the cover assembly includes a cover hanger portion connected to a cover horizontal holding structure, and wherein the cover assembly includes a zipper to facilitate the necktie and handkerchief holding device being capable of being placed within the cover assembly.

19. A necktie and handkerchief holding device comprising:

a hanger capable of being hung on a rod, an upper horizontal holding device connected to the hanger, a plurality of vertically attached pockets supported by the upper horizontal holding device, the plurality of vertically attached pockets capable of holding handkerchiefs, or other accessories, a plurality of lower horizontal holding devices located between each of the plurality of vertically attached pockets, and a spring clip attached to each end of the upper horizontal holding device and each end of the plurality of lower horizontal holding devices, the spring clips capable of securely holding a necktie.

* * * * *